US007388562B2

(12) United States Patent
Koyama et al.

(10) Patent No.: US 7,388,562 B2
(45) Date of Patent: Jun. 17, 2008

(54) DISPLAY DEVICE AND DRIVING METHOD OF THE SAME

(75) Inventors: Jun Koyama, Kanagawa (JP); Mitsuaki Osame, Kanagawa (JP); Aya Anzai, Kanagawa (JP); Yu Yamazaki, Tokyo (JP); Ryota Fukumoto, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 611 days.

(21) Appl. No.: 10/876,734

(22) Filed: Jun. 28, 2004

(65) Prior Publication Data

US 2004/0263508 A1 Dec. 30, 2004

(30) Foreign Application Priority Data

Jun. 30, 2003 (JP) ..... 2003-189038

(51) Int. Cl.
*G09G 3/30* (2006.01)

(52) U.S. Cl. ..... 345/76

(58) Field of Classification Search ..... 345/76, 345/77, 82–83, 211
See application file for complete search history.

(56) References Cited

U.S. PATENT DOCUMENTS

| | | | | |
|---|---|---|---|---|
| 6,229,506 | B1 | 5/2001 | Dawson | |
| 6,518,941 | B1 | 2/2003 | Kimura | |
| 6,583,775 | B1 | 6/2003 | Sekiya | |
| 6,661,180 | B2 | 12/2003 | Koyama | |
| 6,730,966 | B2 | 5/2004 | Koyama | |
| 6,798,405 | B2 | 9/2004 | Anzai | |
| 6,809,482 | B2 | 10/2004 | Koyama | |
| 6,909,242 | B2 | 6/2005 | Kimura | |
| 7,113,154 | B1 | 9/2006 | Inukai | |
| 7,122,969 | B2 * | 10/2006 | Fukumoto et al. | 315/169.3 |
| 7,141,934 | B2 | 11/2006 | Osame | |
| 7,173,586 | B2 | 2/2007 | Osame | |
| 7,180,245 | B2 | 2/2007 | Yamazaki | |
| 7,187,350 | B2 | 3/2007 | Yoshida | |
| 7,218,294 | B2 | 5/2007 | Koyama | |
| 7,247,995 | B2 | 7/2007 | Osame | |
| 7,250,720 | B2 | 7/2007 | Sakakura | |
| 2002/0005825 | A1 * | 1/2002 | Lee et al. | 345/76 |
| 2002/0153844 | A1 | 10/2002 | Koyama | |
| 2003/0071772 | A1 | 4/2003 | Kimura | |
| 2003/0117352 | A1 | 6/2003 | Kimura | |
| 2003/0137503 | A1 * | 7/2003 | Kimura et al. | 345/212 |
| 2003/0197663 | A1 | 10/2003 | Lee | |

(Continued)

FOREIGN PATENT DOCUMENTS

| | | |
|---|---|---|
| EP | 0 949 603 | 10/1999 |

(Continued)

*Primary Examiner*—Amr A. Awad
*Assistant Examiner*—Randal Willis
(74) *Attorney, Agent, or Firm*—Fish & Richardson P.C.

(57) ABSTRACT

A display device in which the influence of a parasitic capacitance or a wiring capacitance is suppressed without lowering OFF-current of a switching transistor or increasing the capacitance of a capacitor, and a driving method thereof using area gray scale display in particular. The display device of the invention comprises a plurality of sub pixels each including a driving transistor whose gate potential is fixed, and area gray scale display is achieved. Specifically, each of the sub pixels comprises, in addition to the driving transistor, a switching transistor, a current controlling transistor connected in series with the driving transistor, and a light emitting element.

41 Claims, 10 Drawing Sheets

U.S. PATENT DOCUMENTS

| | | | | |
|---|---|---|---|---|
| 2003/0222589 | A1 | 12/2003 | Osame et al. | |
| 2004/0041752 | A1* | 3/2004 | Kimura | 345/76 |
| 2004/0251953 | A1 | 12/2004 | Yamazaki | |
| 2004/0252565 | A1 | 12/2004 | Yamazaki | |
| 2004/0263506 | A1 | 12/2004 | Koyama | |
| 2005/0001830 | A1 | 1/2005 | Osame | |
| 2005/0012686 | A1 | 1/2005 | Osame | |
| 2005/0156829 | A1* | 7/2005 | Choi et al. | 345/76 |
| 2007/0085796 | A1 | 4/2007 | Osame | |
| 2007/0132677 | A1 | 6/2007 | Osame | |
| 2007/0138479 | A1 | 6/2007 | Yamazaki | |
| 2007/0177088 | A1 | 8/2007 | Koyama | |

FOREIGN PATENT DOCUMENTS

| | | |
|---|---|---|
| EP | 1 063 630 | 12/2000 |
| JP | 11-073158 | 3/1999 |
| JP | 2001-005426 | 1/2001 |
| JP | 2002-278497 | 9/2002 |
| JP | 2003-295793 | 10/2003 |

* cited by examiner

DISPLAY DEVICE AND DRIVING METHOD OF THE SAME

BACKGROUND OF THE INVENTION

1. Field of the Invention

The present invention relates to a display device comprising light emitting elements and to a driving method thereof.

2. Description of the Related Art

In recent years, a display device using light emitting elements (self light emitting elements) has been studied and developed. Such a display device has the advantages of high image quality, reduced thickness, light weight, and the like, and thus it is widely used as a display screen of a mobile phone and a monitor of a personal computer. In particular, the light emitting display device has the features such as low voltage driving, low power consumption, and fast response which contributes to dynamic display, therefore, it is expected to be widely used for various electronic apparatuses typified by a next-generation mobile phone or portable information terminal (PDA).

A light emitting element comprises an anode, a cathode, and a layer including an electro luminescent material (hereinafter referred to as an electro luminescent layer) which generates the electro luminescence when an electric field is applied. The electro luminescent layer is sandwiched between the anode and the cathode. There is a fixed relation between the amount of current flowing in the light emitting element and the luminance thereof, and the light emitting element emits light at a luminance corresponding to the amount of current flowing in its electro luminescent layer.

For displaying a multi-level image in the light emitting display device, either an analog driving method (analog gray scale display) or a digital driving method (digital gray scale display) is adopted. These methods are different in the way of controlling a light emitting element during a light emission or a non-light emission of the light emitting element.

In the analog driving method, gray scale is achieved by continuously controlling the amount of current flowing in the light emitting element. Meanwhile, in the digital driving method, the display device is driven by switching two states of the light emitting element, namely, ON (the luminance is substantially 100%) and OFF (the luminance is substantially 0%) states.

Brief explanation is hereinafter made on a pixel configuration of a display device using a common digital driving method as well as an operation of the pixel. A pixel shown in FIG. 8 comprises a switching transistor 700, a driving transistor 701, a capacitor 702, and a light emitting element 703. A gate of the switching transistor 700 is connected to a scan line 705, either a source or a drain thereof is connected to a signal line 704, and the other is connected to a gate of the driving transistor 701. A source of the driving transistor 701 is connected to a power supply line 706 and a drain thereof is connected to an anode of the light emitting element 703. A cathode of the light emitting element 703 is connected to a counter electrode 707. The capacitor 702 is provided in order to hold a potential difference between the gate and the source of the driving transistor 701. A predetermined voltage is applied from a power supply to each of the power supply line 706 and the counter electrode 707 so as to have a potential difference therebetween.

When the switching transistor 700 is turned ON by a signal from the scan line 705, a video signal is inputted from the signal line 704 to the gate of the driving transistor 701. A potential difference between the inputted video signal and the power supply line 706 corresponds to a gate-source voltage Vgs of the driving transistor 701, and thus a current is supplied to the light emitting element 703 which emits light consequently.

In the digital driving method, however, not more than two-level gray scale display can be achieved without any complement. Therefore, area gray scale display or time gray scale display is suggested to be used as a driving method for displaying a multi-level image. The area gray scale display is a method in which a pixel is divided into sub pixels so as to have different light emitting areas and gray scale display is achieved by selecting the sub pixels. The area gray scale display is specifically disclosed in Patent Document 1.

[Patent Document 1]

Japanese Patent Laid-Open No. H11-73158

SUMMARY OF THE INVENTION

In the case of using the aforementioned driving method of a display device, variations in luminance of light emitting elements are caused by variations in current characteristics of driving transistors for determining a current amount flowing in the light emitting elements, leading to display variations.

For example, in the case where a drain current of the driving transistor 701 varies in each pixel in FIG. 8, display variations of the light emitting element 703 are caused even when the same video signal potential is applied. In order to suppress variations in drain current, a method is disclosed in Japanese Patent Laid-Open No. 2003-008719, in which the ratio L/W (L: channel length, W: channel width) of the driving transistor 701 is increased.

A drain current Ids of the driving transistor 701 operating in a saturation region is represented by formula 1 with a coefficient β.

$$Ids=\beta(Vgs-Vth)2/2 \quad \text{[Formula 1]}$$

As can be expected from formula 1, a slight variation in Vgs significantly influences the drain current Ids of the driving transistor 701 which operates in a saturation region. Therefore, the gate-source voltage Vgs of the driving transistor 701 has to be held constant during a period in which the light emitting element 703 emits light. For this reason, OFF-current of the switching transistor 700 has to be lowered and the capacitance of the capacitor 702 provided between the gate and the source of the driving transistor 701 has to be increased. However, it is difficult in view of the design and manufacturing steps of transistors, to lower OFF-current of the switching transistor 700 while increasing ON-current required for charging a large capacitance.

Further, the Vgs of the driving transistor 701 may vary according to switching of the switching transistor 700, changes in potential of the signal line and the scan line, and the like. Such a problem is assumed to be caused by drop in voltage due to a parasitic capacitance in the gate of the driving transistor 701 or a wiring capacitance.

The invention provides a display device and a driving method thereof, in which the influence of a parasitic capacitance or a wiring capacitance is suppressed while not increasing the L/W of the driving transistor 701, lowering OFF-current of the switching transistor 700, and increasing the capacitance of the capacitor 702.

In view of the foregoing, the invention provides a display device comprising a plurality of sub pixels each having a driving transistor whose gate potential is fixed. In order to keep the gate potential constant, a gate electrode of the driving transistor is connected to a power supply line having a fixed potential. It is to be noted that the connection between components means that they are electrically connected to each other, and a capacitor, a switch or the like may be interposed therebetween.

By fixing the gate potential of the driving transistor, variations in gate-source voltage Vgs due to a parasitic capacitance or a wiring capacitance can be suppressed. Accordingly, it is possible to suppress display variations due to variations in gate-source voltage Vgs of the driving transistor.

In addition to the driving transistor, a sub pixel of the invention comprises a switching transistor for determining a light emission or a non-light emission of a light emitting element according to a video signal, and a current controlling transistor which is connected in series with the driving transistor.

The sub pixel of the invention may further comprise a capacitor between a gate and a source of the current controlling transistor as needed. However, the capacitor is not required to be provided in the case where the switching transistor, the driving transistor, or the current controlling transistor has a large gate capacitance and a leakage current of each transistor is within an allowance.

A gate electrode of the driving transistor is connected to a first power supply line which has a fixed potential, whereas a source electrode or a drain electrode of the current controlling transistor is connected to a second power supply line.

A power supply line which has a fixed potential may be formed parallel to either a signal line or a scan line, and may also be formed of the same conductive layer as the signal line, the scan line, other wirings or electrodes.

For a transistor in the invention, a polycrystalline silicon thin film transistor (a thin film transistor is referred to as a TFT), an amorphous silicon thin film transistor, or other transistors may be used. That is, the structure of a transistor is not limited in the invention. Further, the conductivity of a transistor is not limited in the invention either. When using an amorphous silicon thin film transistor, however, it is preferable to use N-channel thin film transistors for all the transistors.

In a display device having the aforementioned pixel configuration, each sub pixel including a light emitting element is formed so as to have different light emitting areas from each other such as to be 1:2:4:8 . . . , and area gray scale display is performed by selecting the light emitting areas.

In addition to the area gray scale display, time gray scale display can also be performed in a display device having the aforementioned pixel configuration. The time gray scale display is performed by dividing one frame period into m sub frame periods SF1, SF2, . . . , SFm (m is a natural number of two or more), and selecting the sub frame periods. According to these gray scale methods, the number of gray scale levels can be further increased, leading to higher level gray scale display.

Such gray scale display can be achieved by either a constant current drive or a constant voltage drive. That is, the driving transistor may operate in either a saturation region or a linear region.

The amount of current flowing in the light emitting element is not influenced by a slight variation in current Id based on the gate-source voltage Vgs of the current controlling transistor. In other words, the current controlling transistor serves as a switch, and therefore, it can operate in a linear region. Similarly, the switching transistor and the like function as switches and they can thus operate in a linear region. A source-drain voltage Vds of a transistor is lowered when it operates in a linear region, resulting in lower power consumption.

On the other hand, when the driving transistor operates in a saturation region while the current controlling transistor operates in a linear region, the amount of current flowing in the light emitting element is kept constant even without increasing the capacitance of a capacitor provided between the gate and the source of the current controlling transistor or lowering OFF-current of the switching transistor. Further, the current amount flowing in the light emitting element is not influenced by a parasitic capacitance in the gate of the current controlling transistor. Accordingly, by operating the driving transistor in a saturation region while operating the current controlling transistor in a linear region, causes of display variations are further suppressed and image quality of the display device can be improved drastically.

Since OFF-current of the switching transistor is not required to be lowered, manufacturing steps of transistors can be simplified. That is, the strict manufacturing requirements to lower OFF-current can be reduced and a wider margin can be set, which contributes to improved productive yield.

In the invention, the luminescence in an electro luminescent layer includes luminescence that is generated when an excited singlet state returns to a ground state (fluorescence) and luminescence that is generated when an excited triplet state returns to a ground state (phosphorescence).

The display device of the invention includes a panel and a module in which an IC and the like having a controller are mounted on the panel.

DETAILED DESCRIPTION OF THE INVENTION

Figure 1:
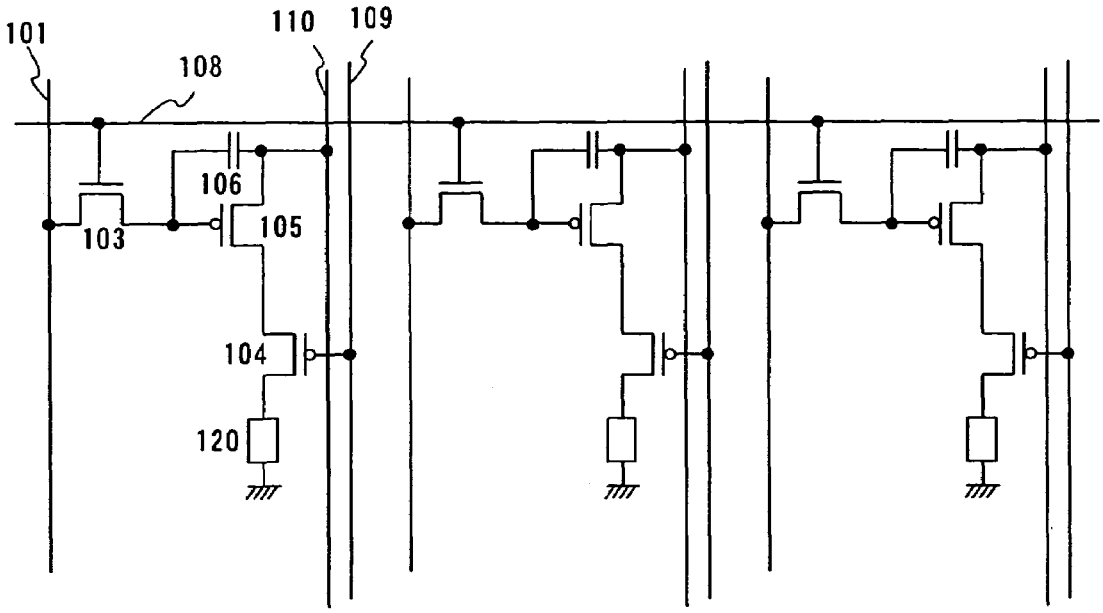
FIG. 1 is a circuit diagram showing a pixel of the display device of the invention.

Embodiment modes of the invention are described below with reference to accompanying drawings. It is to be noted that in all the drawings which show the embodiment modes of the invention, the same components or components having the same function are denoted by the same reference numerals and the description thereof is omitted.

Further, a transistor comprises three terminals of a gate, a source and a drain in the following embodiment modes. However, because of the structure of a transistor, it is not possible to make a clear distinction between the source electrode and the drain electrode in particular. Thus, when describing the connection between components, either the source electrode or the drain electrode is referred to as a first electrode and the other is referred to as a second electrode.

Embodiment Mode 1

Described in this embodiment mode are an equivalent circuit of a pixel including sub pixels and an operation of the same.

FIG. 1 shows an equivalent circuit of a sub pixel which comprises a light emitting element 120, a signal line 101 to which a video signal is inputted, a switching transistor 103 for controlling a video signal input to a pixel, a driving transistor 104 for controlling a current amount flowing in the light emitting element 120, a current controlling transistor 105 for controlling a current supply to the light emitting element 120, and a capacitor 106 for holding a video signal potential. Either an enhancement mode transistor or a depletion mode transistor can be used for each of the transistors.

In this embodiment mode, an N-channel transistor is used for the switching transistor 103, whereas P-channel transistors are used for the driving transistor 104 and the current controlling transistor 105.

The capacitor 106 is not required to be provided when the switching transistor 103, the driving transistor 104, or the current controlling transistor 105 has a large gate capacitance and a leakage current of each transistor is within an allowance.

The components in such a pixel configuration are connected to each other as below. A gate electrode of the switching transistor 103 is connected to a scan line 108, a first electrode thereof is connected to the signal line 101, and a second electrode thereof is connected to a gate electrode of the current controlling transistor 105. A first electrode of the current controlling transistor 105 is connected to a second power supply line 110, and the capacitor 106 is provided between the gate and the source of the current controlling transistor 105. The capacitor 106 is connected so as to hold a potential difference between the gate and the source of the current controlling transistor 105, namely a video signal potential, when the switching transistor 103 is not selected (OFF state). Therefore, one electrode of the capacitor 106 is connected to the gate electrode of the current controlling transistor 105 and the other electrode thereof is connected to either a first power supply line 109 or the second power supply line 110. A gate electrode of the driving transistor 104 is connected to the first power supply line 109 which has a fixed potential, and a second electrode thereof is connected to an anode of the light emitting element 120. It is to be noted that the second electrode of the driving transistor 104 may be connected to a cathode of the light emitting element 120 depending on a pixel configuration.

Although the first power supply line 109 which has a fixed potential is provided in each sub pixel in FIG. 1, it may be shared among the sub pixels. For example, wirings may be led out so that gate electrodes of each driving transistor are connected to one power supply line which has a fixed potential.

The driving transistor 104 and the current controlling transistor 105 are connected to each other so that a current from the second power supply line 110 is supplied to the light emitting element 120 as a drain current of the driving transistor 104 and the current controlling transistor 105.

By providing a plurality of sub pixels which have the aforementioned configuration and controlling areas of light emission from each light emitting element, area gray scale display is achieved.

Figure 2A:
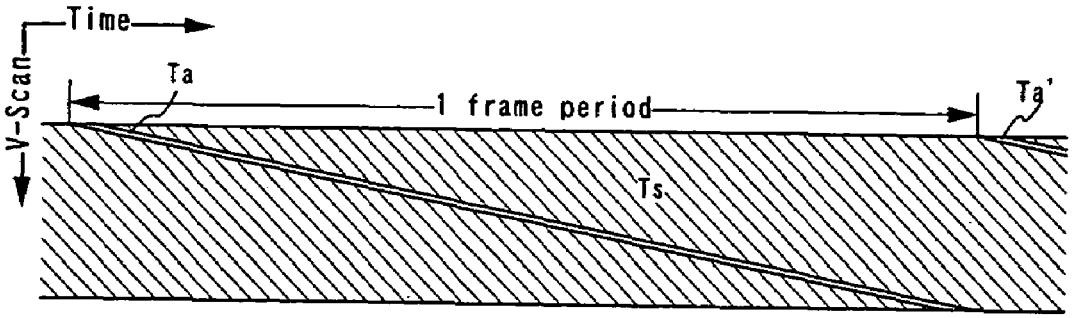
FIGS. 2A and 2B are timing charts in a pixel of the display device of the invention.
Figure 2B:
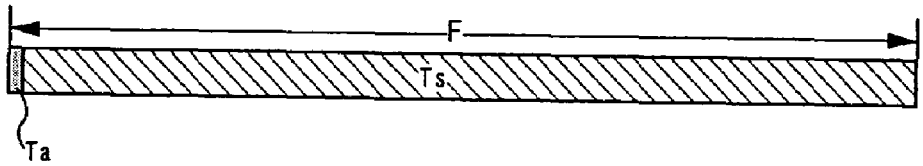

Specific operations of each transistor in the sub pixel are described with reference to timing charts of FIGS. 2A and 2B. FIG. 2A is a timing chart whose ordinate represents scan lines and whose abscissa represents the time. FIG. 2B is a timing chart of a scan line Gj in j-th row. In this embodiment mode, a case in which the current controlling transistor 105 operates in a linear region while the driving transistor 104 operates in a saturation region is shown as an example.

It is assumed that a frame frequency of the display device is approximately 60 Hz. That is, writing of a display screen is performed about 60 times per second. A period of performing one writing of a display screen is referred to as a frame period (unit frame period). Note that the frame frequency may be 60 Hz or more, for example, 90 Hz or 120 Hz. A frame period of each sub pixel is divided into a writing period Ta and a light emitting period Ts as shown in FIG. 2A.

In the writing period Ta, the scan line 108 is sequentially selected, and then the switching transistor 103 connected to the scan line 108 is turned ON. When the switching transistor 103 is turned ON, charges are built up on the capacitor 106 in accordance with a video signal inputted from the signal line. When the charges reach the threshold voltage of the current controlling transistor 105, the current controlling transistor 105 is turned ON and the driving transistor 104 is turned ON at the same time. Thus, a current is supplied to the light emitting element 120 based on the gate-source voltage Vgs of the driving transistor 104. Since the current controlling transistor 105 operates in a linear region at this time, the amount of current flowing in the light emitting element 120 is determined by voltage-current characteristics of the driving transistor 104 operating in a saturation region and the light emitting element 120. The gate electrode of the driving transistor 104 is connected to a power supply line which has a fixed potential, therefore, drop in voltage due to a parasitic capacitance or a wiring capacitance is prevented and thus the gate-source voltage Vgs is kept constant.

Accordingly, variations in current supplied to the light emitting element 120 due to the Vgs of the driving transistor 104 in particular can be suppressed. Further, as the driving transistor 104 operates in a saturation region, variations in luminance caused by the change with time of the light emitting element 120 can also be suppressed.

Thus, the light emitting element 120 emits light at a luminance corresponding to the supplied current, and the light emitting period Ts starts.

In the light emitting period Ts, the switching transistor 103 is turned OFF by controlling a potential of the scan line 108, and the video signal potential which has been written in the writing period Ta is held in the capacitor 106. As a result, the light emitting element 120 continues to emit light.

In the case where in the writing period Ta, the current controlling transistor 105 is turned OFF in accordance with a video signal inputted from the signal line, no current is supplied to the light emitting element 120. In that case, a potential is not held in the capacitor 106 in the light emitting period Ts, and thus the light emitting element 120 emits no light.

That is, when the current controlling transistor 105 is turned ON in the writing period Ta, a video signal potential is held in the capacitor 106 in the light emitting period Ts, and thus the light emitting element 120 is constantly supplied with a current and continues to emit light. On the other hand, when the current controlling transistor 105 is turned OFF in the writing period Ta, a video signal potential is not held in the capacitor 106 in the light emitting period Ts, and thus the light emitting element is not supplied with a current and emits no light.

As set forth above, gray scale display is performed by switching a light emission and a non-light emission of the light emitting element. In particular, the area gray scale display is achieved by switching a light emission and a non-light emission of the light emitting element while making differences between areas of light emission of the light emitting elements in each sub pixel.

The luminance of the light emitting element is proportional to the gate-source voltage Vgs of the driving transistor. Therefore, a pixel circuit which is capable of keeping constant the gate-source voltage Vgs of the driving transistor allows to suppress variations in luminance. Thus, a pixel configuration in which display variations are suppressed is achieved as well as the area gray scale display using the pixel configuration.

Embodiment Mode 2

Described in this embodiment mode are an equivalent circuit of a pixel including sub pixels which are different from those shown in Embodiment Mode 1 and an operation of the same.

Figure 3:
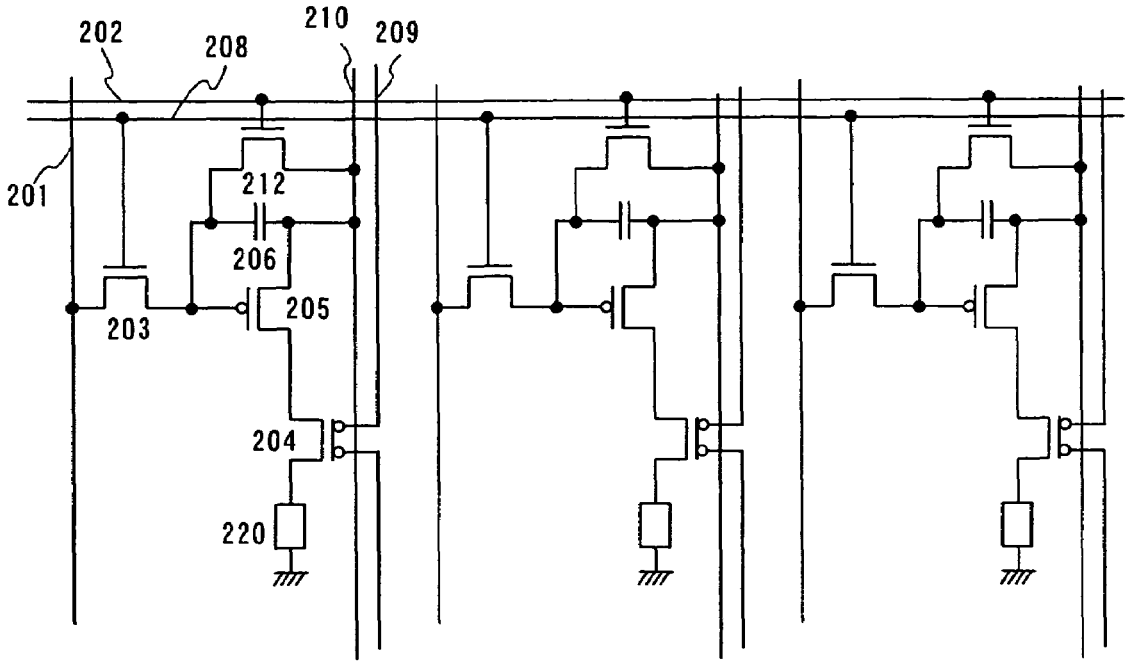
FIG. 3 is a circuit diagram showing a pixel of the display device of the invention.

An equivalent circuit shown in FIG. 3 is different from that shown in FIG. 1 in that a transistor 212 for erasing a potential of a written video signal (hereinafter referred to as an erasing transistor 212) is additionally provided. A sub pixel shown in FIG. 3 comprises a light emitting element 220, a signal line 201 to which a video signal is inputted, a switching transistor 203 for controlling a video signal input to a pixel, a driving transistor 204 for controlling a current amount flowing in the light emitting element 220, a current controlling transistor 205 for controlling a current supply to the light emitting element 220, the erasing transistor 212 for erasing a potential of a written video signal, and a capacitor 206 for holding a video signal potential. Either an enhancement mode transistor or a depletion mode transistor may be used for each of the transistors.

Note that, in order to obtain an enhancement mode transistor or a depletion mode transistor for each transistor, the concentration of impurities to be added may vary.

In this embodiment mode, an N-channel transistor is used for the switching transistor 203, whereas P-channel transistors are used for the driving transistor 204 and the current controlling transistor 205.

The symbol of the driving transistor 204 in FIG. 3 is explained herein. The driving transistor 204 is a transistor having two contacts in a gate electrode, and shown in a different way than the other transistors in order to show a difference in connection (shown in more detail in a region 250 of FIG. 6). In the sub pixel shown in FIG. 3, the driving transistor 204 is connected so that the gate electrode thereof is connected to a wiring at two contacts and the gate is used as a part of the wiring, whereby reducing an area in which a second power supply line 210 is arranged on the same layer as and parallel to a signal line 201 and a first power supply line 209.

It is to be noted that the aforementioned connection of the driving transistor 204 is just an example, and the driving transistor 204 may be connected in the usual way.

The capacitor 206 is not required to be provided when the switching transistor 203, the driving transistor 204, or the current controlling transistor 205 has a large gate capacitance and a leakage current of each transistor is within an allowance.

The components in such a pixel configuration are connected to each other as below. A gate electrode of the switching transistor 203 is connected to a scan line 208, a first electrode thereof is connected to the signal line 201, and a second electrode thereof is connected to a gate electrode of the current controlling transistor 205. A first electrode of the current controlling transistor 205 is connected to a second power supply line 210, and the capacitor 206 is provided between the gate and the source of the current controlling transistor 205. The capacitor 206 holds a potential difference between the gate and the source of the current controlling transistor 205 when the switching transistor 203 is not selected (OFF state). In other words, the capacitor 206 is provided to hold a video signal potential. A gate electrode of the driving transistor 204 is connected to a first power supply line 209 which has a fixed potential, and a second electrode thereof is connected to an anode of the light emitting element 220. It is to be noted that the second electrode of the driving transistor 204 may be connected to a cathode of the light emitting element 220 depending on a pixel configuration.

Although the first power supply line 209 which has a fixed potential is provided in each sub pixel in FIG. 3, it may be shared among the sub pixels. For example, wirings may be led out so that gate electrodes of each driving transistor are connected to one power supply line which has a fixed potential.

The driving transistor 204 and the current controlling transistor 205 are connected to each other so that a current from the second power supply line 210 is supplied to the light emitting element 220 as a drain current of the driving transistor 204 and the current controlling transistor 205.

A gate electrode of the erasing transistor 212 is connected to an erasing scan line 202, and each of a first electrode and a second electrode thereof is connected to either of two electrodes of the capacitor 206. That is, the erasing transistor 212 is disposed so as to erase a video signal potential held in the capacitor 206.

By using a sub pixel including such erasing transistor 212, time gray scale display can be performed in combination with area gray scale display. In the time gray scale display, as disclosed in Japanese Patent Laid-Open No. 2001-5426, gray scale display is achieved by controlling light emitting periods of a light emitting element. Note that an erasing transistor is not necessarily provided in the time gray scale display.

A specific operation of the sub pixel shown in FIG. 3 is divided into a writing period Ta, a light emitting period Ts and an erasing period Te. Operations in each period are described below.

Figure 4A:
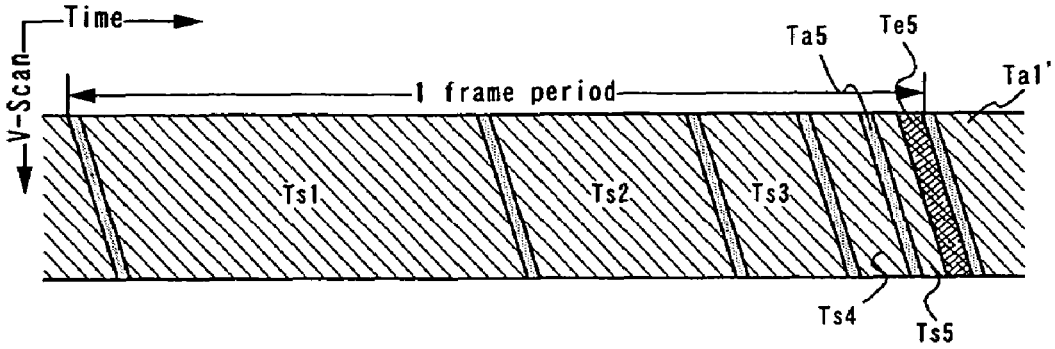
FIGS. 4A and 4B are timing charts in a pixel of the display device of the invention.
Figure 4B:
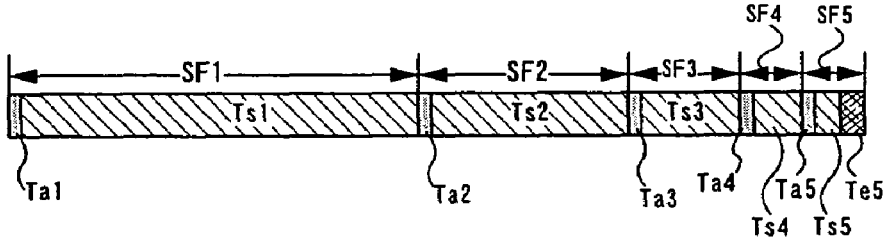

FIGS. 4A and 4B are timing charts in the case where one frame period is divided into five sub frame periods SF1 to SF5 and an image is displayed with 5-bit gray scale. The number of sub frames is equal to the number of bits in many cases, however, they may differ from each other in some cases. FIG. 4A is a timing chart whose ordinate represents scan lines and whose abscissa represents the time. FIG. 4B is a timing chart of a scan line Gj in j-th row. In this embodiment mode, a case in which the current controlling transistor 205 operates in a linear region while the driving transistor 204 operates in a saturation region is shown as an example.

Operations in the wiring period Ta and the light emitting period Ts are the same as those shown in Embodiment Mode 1, therefore, the description thereof is omitted herein.

In the erasing period Te, the erasing scan line 202 is selected and the erasing transistor 212 is turned ON, then, a potential of the second power supply line 210 is supplied to the gate of the current controlling transistor 205 via the erasing transistor 212. Then, charges held in the capacitor 206 are discharged to turn the current controlling transistor 205 OFF, and thus no current is supplied to the light emitting element 220.

The erasing period Te allows the next writing period to start before video signals are written to all the pixels, leading to high-level gray scale display. It is to be noted that the erasing period Te may be provided as needed when adopting the time gray scale display.

When the number of gray scale levels is required to be increased, the number of sub frame periods may be increased. The sub frame periods are not necessarily arranged from the most significant bit to the least significant bit in order, and they may be arranged at random in a frame period. Moreover, the order of sub frame periods may change in each frame period, and a sub frame period may be further divided. According to this, pseudo contour can be prevented.

The area gray scale display, which has a limit to the number of gray scale levels according to the number of sub pixels, may be combined with the time gray scale display to achieve high-level gray scale display. Moreover, by providing an erasing transistor as needed, higher level gray scale can be realized.

Embodiment Mode 3

Described in this embodiment mode is a top plan view corresponding to the pixel circuits shown in FIGS. 1 and 3. For transistors in this embodiment mode, a thin film transistor (TFT) including polycrystalline silicon is used, and a driving TFT operates in a saturation region whereas a current controlling TFT operates in a linear region.

Figure 5:
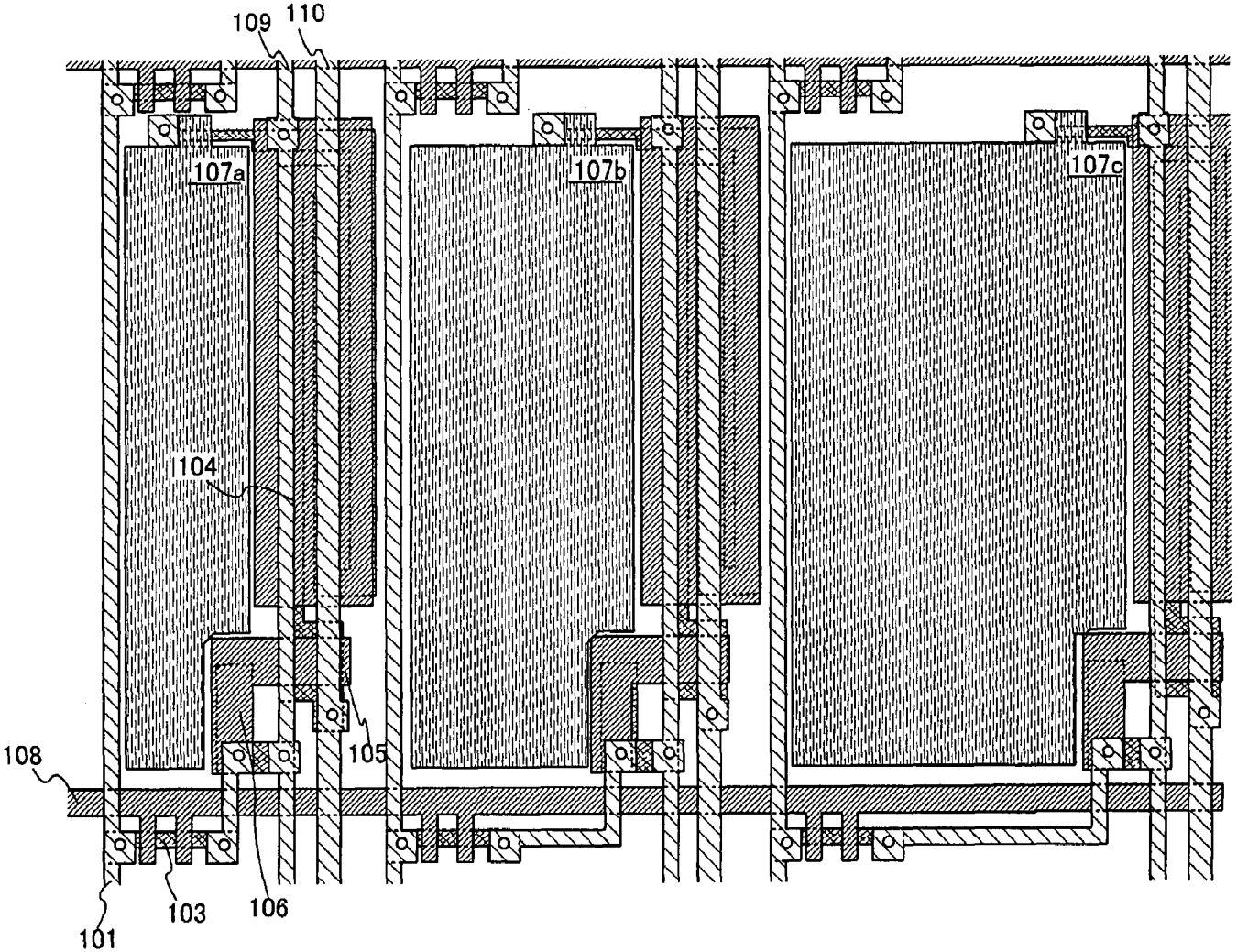
FIG. 5 is a top plan view showing a pixel of the display device of the invention.

FIG. 5 is a top plan view corresponding to the pixel shown in FIG. 1, and comprises the signal line 101, the first power supply line 109, the second power supply line 110, the scan line 108, the switching TFT 103, the driving TFT 104, the current controlling TFT 105, first electrodes 107*a*, 107*b* and 107*c* of the light emitting element, and the capacitor 106.

In FIG. 5, the first current supply line 109 and the second power supply line 110 are formed parallel to the signal line 101. Accordingly, the signal line 101, the first power supply line 109, and the second power supply line 110 can be obtained by patterning the same conductive film.

The switching TFT 103 has a double gate structure in which two gate electrodes are provided over a semiconductor layer, and a part of the scan line 108 functions as these gate electrodes. The first electrode of the switching TFT 103 is connected to the signal line 101 via a contact hole, and the second electrode thereof is connected to the capacitor 106 via a wiring obtained by patterning the same conductive film as the signal line. Further, one electrode of the capacitor 106 is formed of the same conductive layer as the gate electrode of the current controlling TFT 105, and a semiconductor layer corresponding to the other electrode of the capacitor 106 is connected to the first power supply line 109 via a contact hole. A semiconductor layer of the current controlling TFT 105 and a semiconductor layer of the driving TFT 104 are formed of the same island-shaped semiconductor layer and have an impurity region in common, whereby they are connected to each other. The first electrode of the current controlling TFT 105 is connected to the second power supply line 110 via a contact hole.

Since the driving TFT 104 operates in a saturation region, the channel length L is designed longer than the channel width W, and more preferably, the ratio of the L to W is set five or more. In particular, the ratio L/W of the driving TFT 104 is higher than that of the current controlling TFT 105. For example, L/W of the driving TFT 104: L/W of the current controlling TFT 105=5 to 6000:1 is satisfied. Therefore, the semiconductor layer of the driving TFT 104 is rectangular. The gate electrode of the driving TFT 104 is connected to the first power supply line 109 having a fixed potential via a contact hole, and the second electrode thereof is connected to a wiring formed of the same layer as the signal line 101. Anodes 107*a*, 107*b* and 107*c* corresponding to first electrodes of the light emitting elements are formed on and connected to this wiring. The anodes may be connected to the wiring via a contact hole.

The anodes of the light emitting elements are formed of a transparent conductive film typified by ITO (Indium Tin Oxide), and the area ratio 107*a*:107*b*:107*c* is set to be 1:2:4. Then, an electro luminescent layer and a cathode are sequentially formed on the anode. The electro luminescent layer emits light or no light in accordance with a video signal inputted from the signal line 101. Thus, by making such differences between light emitting areas as to be 1:2:4 and selecting these light emitting areas, the area gray scale display can be achieved.

Figure 6:
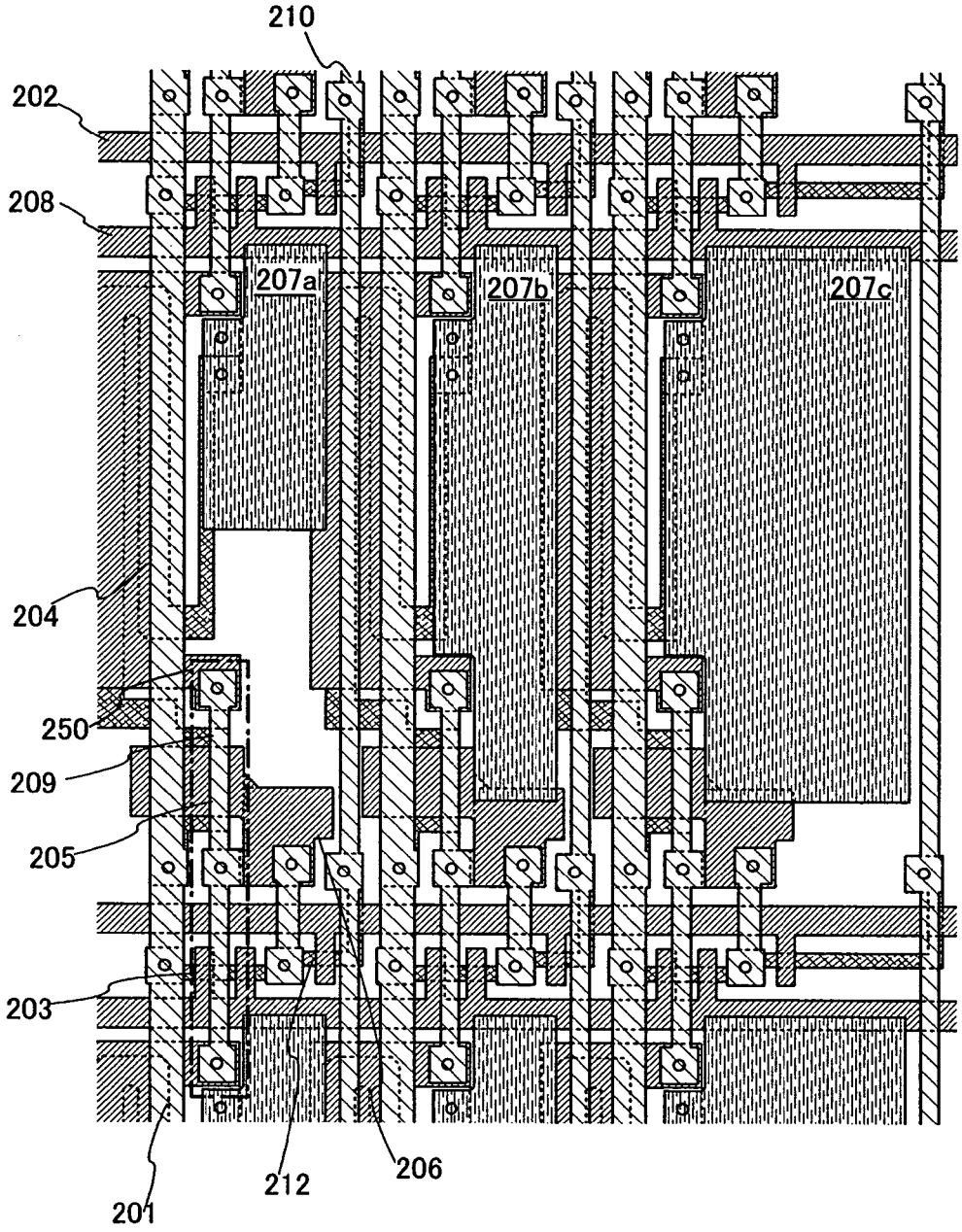
FIG. 6 is a top plan view showing a pixel of the display device of the invention.

FIG. 6 is a top plan view corresponding to the pixel shown in FIG. 3, and comprises the signal line 201, the first power supply line 209, the second power supply line 210, the scan line 208, the switching TFT 203, the driving TFT 204, the current controlling TFT 205, first electrodes 207*a*, 207*b* and 207*c* of the light emitting elements, the capacitor 206, the erasing TFT 212, and the erasing scan line 202.

The switching TFT 203 and the erasing TFT 212 have a double gate structure in which two gate electrodes are provided over a semiconductor layer, and a part of the scan line 208 functions as these gate electrodes. The switching TFT 203 and the erasing TFT 212 are formed of the same island-shaped semiconductor layer and have an impurity region in common, whereby they are connected to each other. The first electrode of the switching TFT 203 is connected to the signal line 201 via a contact hole, and the first electrode of the erasing TFT 212 is connected to the second wiring 210 via a contact hole. The second electrode of the switching TFT 203 and the second electrode of the erasing TFT 212 are connected to the capacitor 206 via a wiring obtained by patterning the same conductive film as the signal line. Further, one electrode of the capacitor 206 is formed of the same conductive layer as the gate electrode of the current controlling TFT 205, and a semiconductor layer corresponding to the other electrode of the capacitor 206 is connected to the first power supply line 209 via a contact hole. A semiconductor layer of the current controlling TFT 205 and a semiconductor layer of the driving TFT 204 are formed of the same island-shaped semiconductor layer and have an impurity region in common, whereby they are connected to each other. The gate electrode of the current controlling TFT 205 is connected to the signal line 201.

The driving transistors in the adjacent pixels are connected to each other via a wiring formed of the same conductive layer as the signal line 201 in a region 250. Specifically, the driving TFTs are connected to each other via the same conductive layer as the scan line 208 in a region other than the region 250, whereas the driving TFTs are connected to each other via the same conductive layer as the signal line 201 in the region 250. According to such a connection, an area occupied by the wirings can be reduced, leading to a larger light emitting area.

Since the driving TFT 204 operates in a saturation region, the channel length L is designed longer than the channel width W, and more preferably, the ratio of the L to W is set five or more. In particular, the ratio L/W of the driving TFT 204 is higher than that of the current controlling TFT 205. For example, L/W of the driving TFT 204: L/W of the current controlling TFT 205=5 to 6000:1 is satisfied. Therefore, the semiconductor layer of the driving TFT 204 is rectangular. The gate electrode of the driving TFT 204 is connected to the first power supply line 209 having a fixed potential via a contact hole in the region 250, and the second electrode thereof is connected to a wiring formed of the same layer as the signal line 201. Anodes 207*a*, 207*b* and 207*c* corresponding to first electrodes of the light emitting elements are connected to this wiring via a contact hole.

The anodes of the light emitting elements are formed of a transparent conductive film typified by ITO, and the area ratio 207*a*:207*b*:207*c* is set to be 1:2:4. Then, an electro luminescent layer and a cathode are sequentially formed on the anode. The electro luminescent layer emits light or no light in accordance with a video signal inputted from the signal line 201. Thus, by making such differences between light emitting areas as to be 1:2:4 and selecting these light emitting areas, the area gray scale display can be achieved.

In order to use an enhancement mode TFT or a depletion mode TFT for each of the TFTs, the concentration of impurities to be added may vary.

Shown above is a top plan view in which a power supply line having a fixed potential is formed parallel to a signal line and formed of the same conductive layer as the signal line, though the power supply line having a fixed potential may be formed parallel to a scan line and formed of the same conductive layer as the scan line. Alternatively, the power supply line may be formed of a different conductive layer than the signal line or the scan line. Further, different power supply lines with a fixed potential may be provided for each electro luminescent layer which emits any of RGB light. That is, the top plan views of this embodiment mode are just examples and the invention is not limited to them.

Drop in voltage due to wiring resistance of a signal line or a power supply line becomes a problem as a display device is increased in size. In that case, a signal line or a power supply line may be formed using a low resistance material, or an auxiliary wiring may be added.

Embodiment Mode 4

Figure 7A:
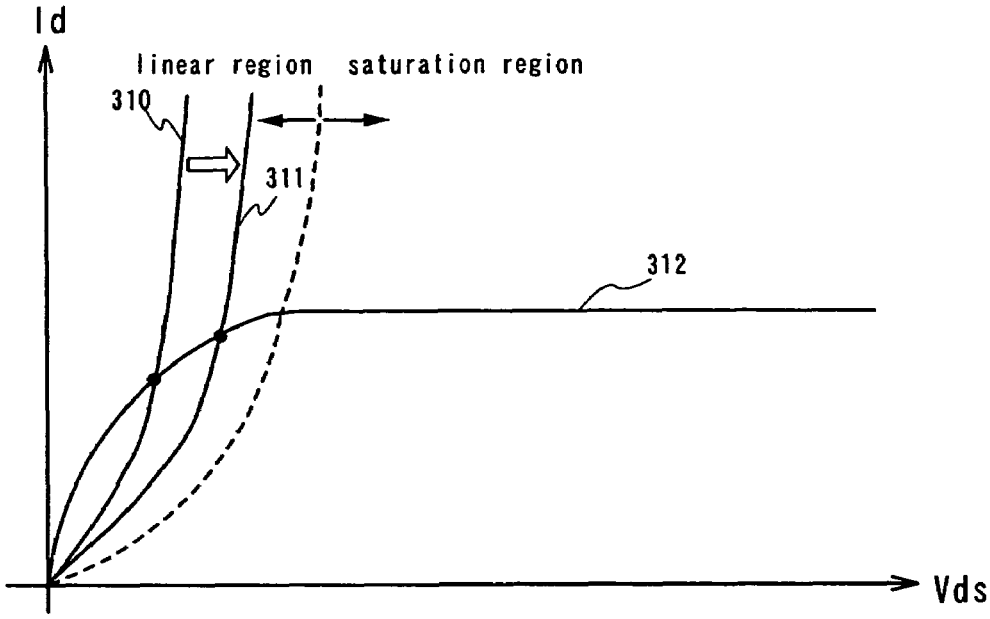
FIGS. 7A and 7B are diagrams showing operating points of the display device of the invention.
Figure 7B:
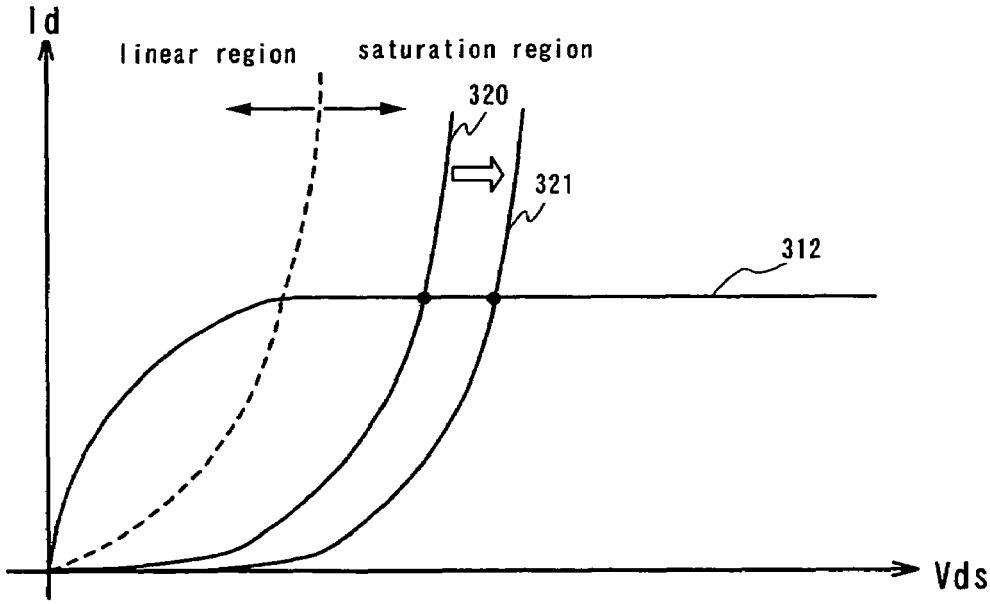
Figure 8:
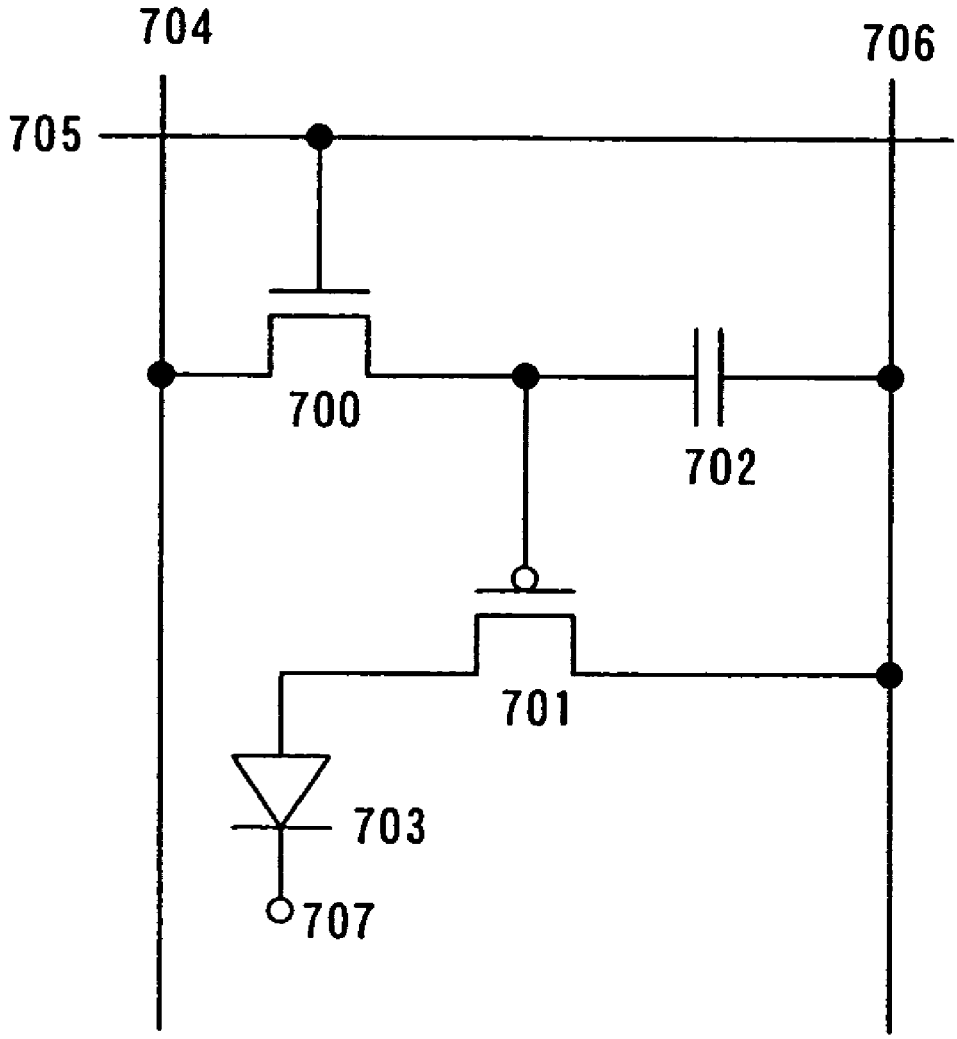
FIG. 8 is a circuit diagram showing a pixel of a display device.

In this embodiment mode, a linear region and a saturation region of a transistor are explained with reference to FIGS. 7A and 7B. FIGS. 7A and 7B show Id-Vds characteristics of a light emitting element and a transistor, and can be divided by an Id-Vds curve 312 of a transistor and a curve (Vgs−Vth=Vds) into a linear region and a saturation region.

In a linear region, Id varies with changes in Vds of a transistor and |Vgs−Vth|>Vds is satisfied. Meanwhile, in a saturation region, Id is kept constant even when the Vds of a transistor varies, and |Vgs−Vth|≦Vds is satisfied.

FIG. 7A shows that an Id-Vds curve 310 of a light emitting element is transformed into an Id-Vds curve 311 as the light emitting element degrades with time. Intersections of the Id-Vds curve 312 of a transistor and each of the curve 310 and the curve 311 are in a linear region.

A driving transistor can operate in such a linear region. According to this, a voltage Vds can be lowered, resulting in lower power consumption of a display device.

Other transistors, e.g., a switching transistor, a current controlling transistor and an erasing transistor can also operate in a linear region.

FIG. 7B shows that an Id-Vds curve 320 of a light emitting element is transformed into an Id-Vds curve 321 as the light emitting element degrades with time. Intersections of the Id-Vds curve 312 of a transistor and each of the curve 320 and the curve 321 are in a saturation region.

A driving transistor can operate in such a saturation region. According to this, a constant current Id can be supplied to a light emitting element regardless of changes with time of the light emitting element, in particular, degradation with time thereof, and thus display variations due to changes with time of the light emitting element can be prevented.

Other transistors, e.g., a switching transistor, a current controlling transistor and an erasing transistor can also operate in a saturation region.

Embodiment Mode 5

Described in this embodiment mode is a cross sectional structure of a sub pixel. Note that in this embodiment mode, a thin film transistor (TFT) including polycrystalline silicon is used as a transistor.

Figure 10A:
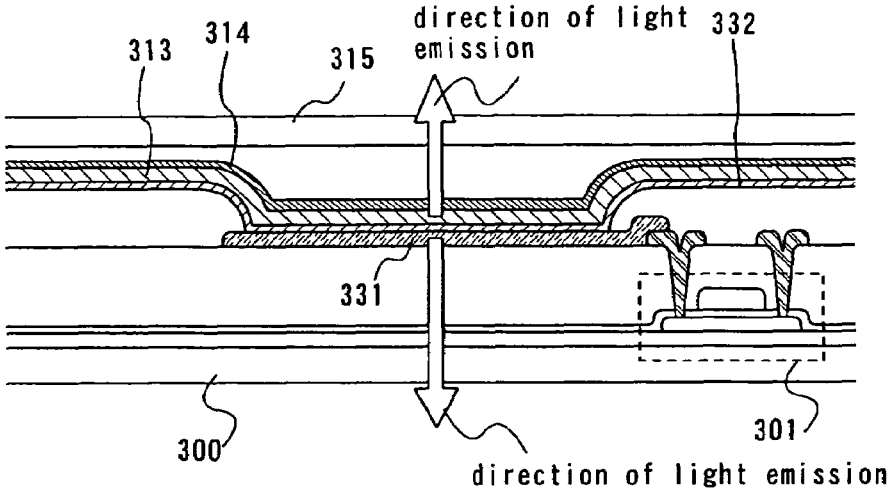
FIGS. 10A to 10C are cross sectional views each showing a pixel of the display device of the invention.

As shown in FIG. 10A, a p-channel driving TFT 301 is formed on a substrate 300 having an insulating surface, and comprises a crystalline semiconductor layer which is crystallized by laser irradiation or heat treatment, or crystallized by using a metal catalyst such as nickel and titanium. A gate electrode and a gate line are formed over the semiconductor layer with a gate insulating layer interposed therebetween, and the semiconductor layer under the gate electrode corresponds to a channel forming region. Then, an impurity element such as boron is added to the semiconductor layer in a self-aligned manner by using the gate electrode as a mask, thus an impurity region serving as a source region and a drain region is obtained. A first insulating layer is formed so as to cover the gate electrode, and contact holes are formed in the first insulating layer on the impurity region. The contact holes include wirings which function as a source wiring and a drain wiring. A first electrode 331 of a light emitting element is formed so as to be electrically connected to the drain electrode. Subsequently, a second insulating layer is formed so as to cover the first electrode 331 and an opening is formed in the second insulating layer over the first electrode 331. The opening includes an electro luminescent layer 332, and a second electrode 313 of the light emitting element is formed so as to cover the electro luminescent layer 332 and the second insulating layer.

The electro luminescent layer 332 includes an HIL (hole injection layer), an HTL (hole transport layer), an EML (emitting layer), an ETL (electron transport layer), and an EIL (electron injection layer), which are laminated in this order on the first electrode 331. Typically, CuPc is used for the HIL, α-NPD is used for the HTL, BCP is used for the ETL, and BCP: Li is used for the EIL.

When displaying a full color image, a material which emits red (R) light, green (G) light, or blue (B) light may be selectively deposited as the electro luminescent layer 332 by vapor deposition using a deposition mask, by ink jet printing, and the like. Specifically, CuPc or PEDOT is used for the HIL, α-NPD is used for the HTL, BCP or Alq3 is used for the ETL, and BCP:Li or CaF2 is used for the EIL. For the EML, Alq3 doped with a dopant corresponding to each of RGB light (DCM for R light, DMQD for G light, and the like) may be used. It is to be noted that the electro luminescent layer is not limited to the aforementioned laminated structure.

A laminated structure of the electro luminescent layer is more specifically exemplified herein. When the electro luminescent layer 332 which emits red light is formed, for example, after forming 30 nm thick CuPc and 60 nm thick α-NPD, Alq3 doped with DCM2 and rubrene is deposited to have a thickness of 40 nm as a red EML; BCP is deposited to have a thickness of 40 nm as an ETL; and BCP doped with Li is deposited to have a thickness of 1 nm as an EIL by using the same deposition mask. When the electro luminescent layer 332 which emits green light is formed, for example, after forming 30 nm thick CuPc and 60 nm thick α-NPD, Alq3 doped with coumarin 545T is deposited to have a thickness of 40 nm as a green EML; BCP is deposited to have a thickness of 40 nm as an ETL; and BCP doped with Li is deposited to have a thickness of 1 nm as an EIL by using the same deposition mask. When the electro luminescent layer 332 which emits blue light is formed, for example, after forming 30 nm thick CuPc and 60 nm thick α-NPD, bis[2-(2-hydroxyphenyl) benzoxazolate]zinc:Zn (PBO) 2 is deposited to have a thickness of 10 nm as a blue EML; BCP is deposited to have a thickness of 40 nm as an ETL; and BCP doped with Li is deposited to have a thickness of 1 nm as an EIL by using the same deposition mask.

CuPc and α-NPD which are common to such electro luminescent layers for each color can be formed over the entire surface of the pixel portion. Further, a mask can be shared with each color. For example, a red electro luminescent layer, a green electro luminescent layer, and a blue electro luminescent layer can be formed by suitably sliding the single mask. Note that the order of the formation can be determined appropriately.

In the case of forming an electro luminescent layer which emits white light, full color display may be performed by separately providing a color filter or a color filter and a color conversion layer, and the like. The color filter and the color conversion layer may be formed on a second substrate before being attached.

A materials are selected in view of the work functions of the first and second electrodes. Described below is a case in which the first electrode servers as an anode and the second electrode serves as a cathode.

For the first electrode, metals having high work functions (4.0 eV), alloys, electrically conductive compounds, and mixture of these materials are preferably used. Specifically, ITO (Indium Tin Oxide), IZO (Indium Zinc Oxide) composed of indium oxide with zinc oxide (ZnO) of 2 to 20%, gold (Au), platinum (Pt), nickel (Ni), tungsten (W), chrome (Cr), molybdenum (Mo), iron (Fe), cobalt (Co), copper (Cu), palladium (Pd), nitride of metal materials (e.g., TiN), and the like can be used.

Meanwhile, for the second electrode, metals having low work functions (3.8 eV or less), alloys, electrically conductive compounds, and mixture of these materials are preferably used. Specifically, a transition metal containing a rare earth metal can be used as well as an element in the first or second periodic row, namely, an alkaline metal such as Li or Cs, or an alkaline earth metal such as Mg, Ca, or Sr, alloys of these elements (Mg:Ag, Al:Li), and compounds (LiF, CsF, CaF2). Note that, since the second electrode has a light transmissivity, these metals or alloys including the metals are formed quite thin, and laminated with a metal (including an alloy) such as ITO.

The first electrode and the second electrode can be formed by vapor deposition, sputtering, or the like.

Either the first electrode or the second electrode may serve as an anode or a cathode depending on a pixel configuration. For example, the first electrode of a driving TFT which has an N-type conductivity may serve as a cathode, whereas the second electrode thereof may serve as an anode.

A passivation layer 314 containing nitrogen is formed by sputtering or CVD, thereby blocking out moisture and oxygen. Space created at this time may be filled with nitrogen and sealed, and a desiccant may be disposed inside the space. Alternatively, the space may be filled with a light transmitting resin having a high water absorption rate. Further, the side surfaces of a display panel may be covered with the first electrode, the second electrode, and other electrodes in order to block out moisture and oxygen. Then, a sealing substrate 315 is attached thereto.

A polarizer or a circular polarizer may be added in order to enhance contrast. For example, a polarizer or a circular polarizer may be provided on either or both of display surfaces.

In a display device which includes such a sub pixel, the first electrode 331 and the second electrode 313 can have a light transmissivity. Therefore, it is possible to provide a display device in which light from a light emitting element can be emitted in both directions shown by arrows at a luminance corresponding to a video signal inputted from a signal line.

In the display device shown in FIG. 10A, in which the area gray scale display is achieved by making differences between light emitting areas of the sub pixels each including a light emitting element and light is emitted in both directions, a transparent conductive layer can be designed larger. Accordingly, the transmissivity can be increased when the light emitting element emits no light.

Figure 10B:
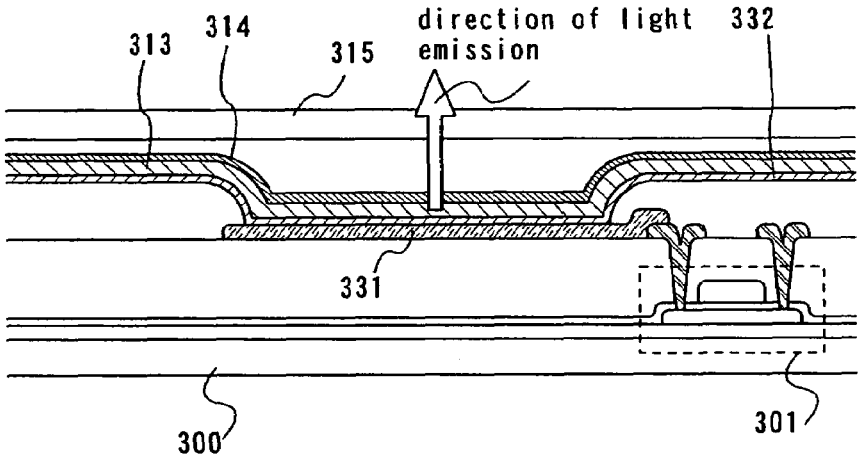

In FIG. 10B, light is emitted in the direction of the sealing substrate 315 only. Therefore, the first electrode 331 is formed of a conductive having no light transmissivity, and preferably, having a high reflectivity. Meanwhile, the second electrode 313 is formed of a conductive film having a light transmissivity. Except these points, the sub pixel shown in FIG. 10B has the same structure as that shown in FIG. 10A, and description thereof is thus omitted herein.

Figure 10C:
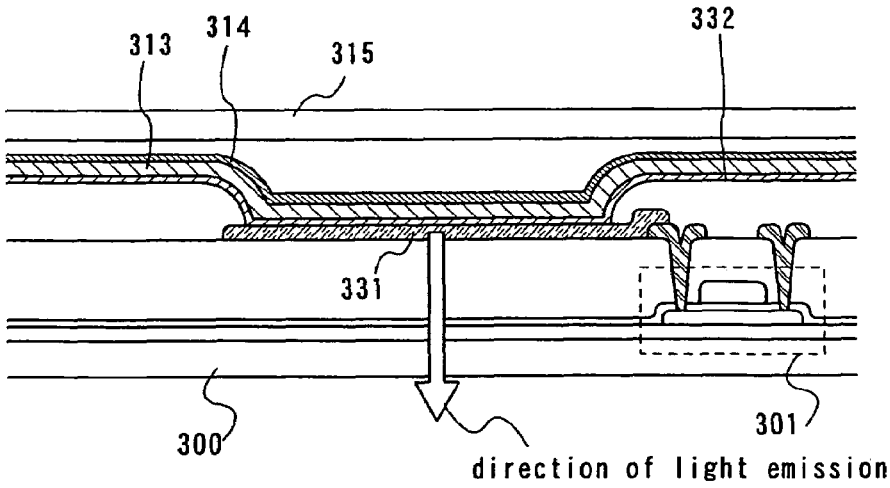

In FIG. 10C, light is emitted in the direction of the substrate 300 only. Therefore, the first electrode 331 is formed of a conductive film having a light transmissivity, whereas the second electrode 313 is formed of a conductive film having no light transmissivity, and preferably, having a high reflectivity. Except these points, the sub pixel shown in FIG. 10C has the same structure as that shown in FIG. 10A, and description thereof is thus omitted herein.

In the case where light is emitted in one direction as shown in FIGS. 10B and 10C, light can be utilized effectively by using a conductive film having a high reflectivity for an electrode of a light emitting element provided in the opposite direction in which light is emitted.

In this embodiment mode, in order to obtain a conductive film having a light transmissivity, a conductive film which having no light transmissivity is formed thin enough to have a light transmissivity, and a conductive film having a light transmissivity may be formed thereon.

Embodiment Mode 6

The sub pixel of the invention can be applied to various electronic apparatuses such as a digital camera, a sound reproducing device such as an in-car audio system, a notebook personal computer, a game player, a portable information terminal (a mobile phone, a portable game player and the like), and an image reproducing device provided with a recording medium, such as a home video game player. Specific examples of these electronic apparatuses are shown in FIGS. 9A to 9H.

Figure 9A:
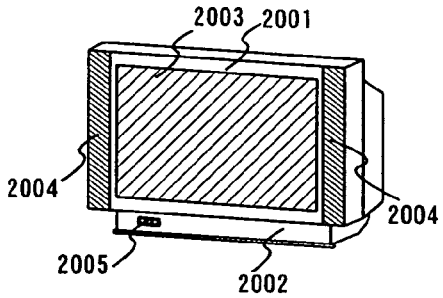
FIGS. 9A to 9H are views showing electronic apparatuses each using a pixel of the invention.

FIG. 9A shows a display device which includes a housing 2001, a supporting base 2002, a display portion 2003, speaker portions 2004, a video input terminal 2005 and the like. The sub pixel of the invention can be applied to the display portion 2003, leading to a display device in which variations in luminance due to variations in characteristics of driving transistors are suppressed.

Figure 9B:
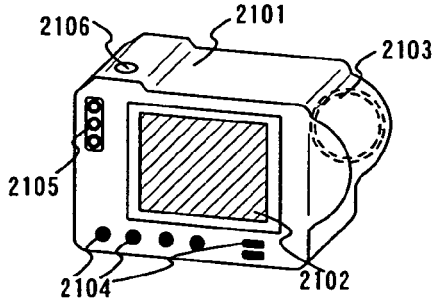

FIG. 9B shows a digital still camera which includes a main body 2101, a display portion 2102, an image receiving portion 2103, operating keys 2104, an external connecting port 2105, a shutter 2106 and the like. The sub pixel of the invention can be applied to the display portion 2102, leading to a digital still camera in which variations in luminance due to variations in characteristics of driving transistors are suppressed.

Figure 9C:
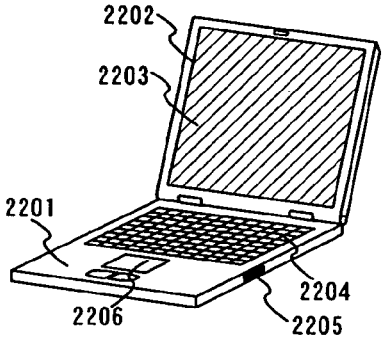

FIG. 9C shows a notebook personal computer which includes a main body 2201, a housing 2202, a display portion 2203, a keyboard 2204, an external connecting port 2205, a pointing mouse 2206 and the like. The sub pixel of the invention can be applied to the display portion 2203, leading to a notebook personal computer in which variations in luminance due to variations in characteristics of driving transistors are suppressed.

Figure 9D:
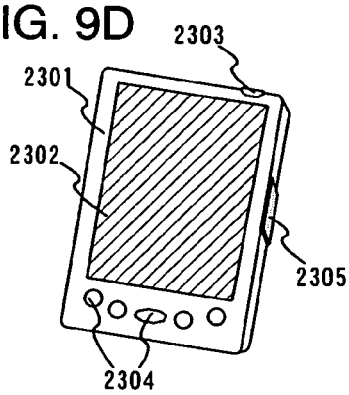

FIG. 9D shows a mobile computer which includes a main body 2301, a display portion 2302, a switch 2303, operating keys 2304, an infrared port 2305 and the like. The sub pixel of the invention can be applied to the display portion 2302, leading to a mobile computer in which variations in luminance due to variations in characteristics of driving transistors are suppressed.

Figure 9E:
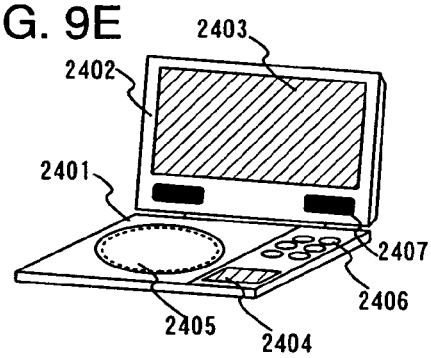

FIG. 9E shows a portable image reproducing device provided with a recording medium, which includes a main body 2401, a housing 2402, a display portion A 2403, a display portion B 2404, an operating key 2406, a speaker portion 2407 and the like. The display portion A 2403 mainly displays image information whereas the display portion B 2404 mainly displays character information. The sub pixel of the invention can be applied to the display portion A 2403 and the display portion B 2404, leading to an image reproducing device in which variations in luminance due to variations in characteristics of driving transistors are suppressed.

Figure 9F:
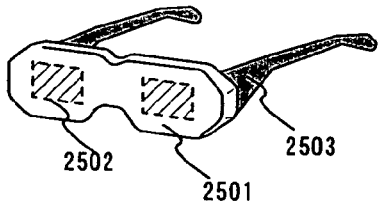

FIG. 9F shows a goggle type display which includes a main body 2501, a display portion 2502, an arm portion 2503 and the like. The sub pixel of the invention can be applied to the display portion 2502, leading to a goggle type display device in which variations in luminance due to variations in characteristics of driving transistors are suppressed.

Figure 9G:
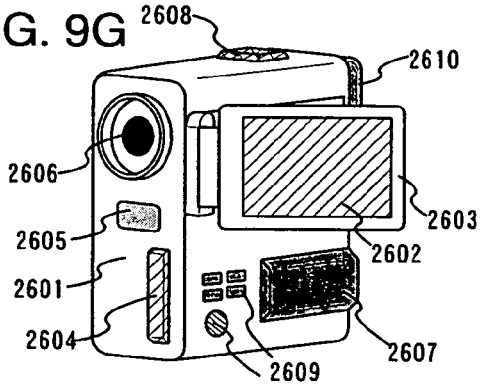

FIG. 9G shows a video camera which includes a main body 2601, a display portion 2602, a housing 2603, an external connecting port 2604, a remote control receiving portion 2605, an image receiving portion 2606, a battery 2607, a sound input portion 2608, operating keys 2609, an eye contacting portion 2610 and the like. The sub pixel of the invention can be applied to the display portion 2602, leading to a video camera in which variations in luminance due to variations in characteristics of driving transistors are suppressed.

Figure 9H:
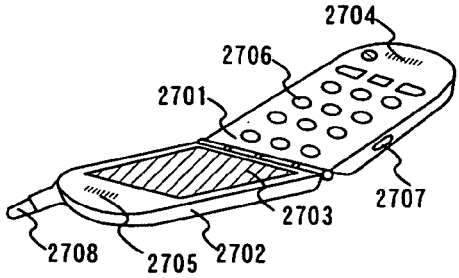

FIG. 9H shows a mobile phone as an example of portable information terminals, which includes a main body 2701, a housing 2702, a display portion 2703, a sound input portion 2704, a sound output portion 2705, an operating key 2706, an external connecting port 2707, an antenna 2708 and the like. The sub pixel of the invention can be applied to the display portion 2703, leading to a mobile phone in which variations in luminance due to variations in characteristics of driving transistors are suppressed.

In the aforementioned electronic apparatuses, by adopting the sub pixel in which a gate potential of a driving transistor is fixed, variations in gate-source voltage due to drop in voltage and the like can be suppressed. As a result, variations in luminance of light emitting elements are suppressed and an image quality of a display device can thus be enhanced.

This embodiment mode can be implemented in combination with the aforementioned embodiment modes.

According to the invention, variations in gate-source voltage Vgs due to a parasitic capacitance or a wiring capacitance can be prevented by fixing a gate potential of a driving transistor. Accordingly, variations in luminance due to variations in characteristics of driving transistors can be suppressed. Further, causes of display variations are reduced, and therefore, image quality of a display device can be improved drastically.

This application is based on Japanese Patent Application serial no. 2003-189038 filed in Japan Patent Office on 30th, Jun., 2003, the contents of which are hereby incorporated by reference.

Although the present invention has been fully described by way of Embodiment Modes and Embodiments with reference to the accompanying drawings, it is to be understood that various changes and modifications will be apparent to those skilled in the art. Therefore, unless such changes and modifications depart from the scope of the present invention hereinafter defined, they should be constructed as being included therein.

What is claimed is:

1. A display device comprising:

a signal line;

a scan line;

a first power supply line having a fixed potential;

a second power supply line;

a pixel including a first sub pixel and a second sub pixel wherein each of the first and second sub pixels has a light emitting element;

a first transistor having gate, source and drain electrodes, wherein one of the source and drain electrodes of the first transistor is electrically connected to the light emitting element of the first sub pixel;

a second transistor having gate, source and drain electrodes, wherein one of the source and drain electrodes of the second transistor is electrically connected to the signal line; and a third transistor having gate, source and drain electrodes and electrically connected in series with the first transistor, wherein the other of the source and drain electrodes of the second transistor is electrically connected to the gate electrode of the third transistor, wherein the gate electrode of the first transistor is electrically connected to the first power supply line, wherein the gate electrode of the second transistor is electrically connected to the scan line, wherein the other of the source and drain electrodes of the first transistor and one of the source and drain electrodes of the third transistor are electrically connected with each others, wherein the other of the source and drain electrodes of the third transistor is electrically connected to the second power supply line, and wherein the size of the light emitting area of the first sub pixel and the size of the light emitting area of the second sub pixel are different.

2. The display device according to claim 1, wherein the third transistor is a current controlling transistor and operates in a linear region.

3. The display device according to claim 1, wherein the first transistor is a driving transistor and operates in a saturation region or a linear region.

4. The display device according to claim 1, wherein the second transistor is a switching transistor and operates in a linear region.

5. The display device according to claim 1, wherein a thin film transistor having polycrystalline silicon is used for each of the transistors.

6. A display device comprising:

a signal line;

a scan line;

a first power supply line having a fixed potential;

a second power supply line;

a capacitor;

a pixel including a first sub pixel and a second sub pixel wherein each of the first and second sub pixels has a light emitting element;

a first transistor having gate, source and drain electrodes, wherein one of the source and drain electrodes of the first transistor is electrically connected to the light emitting element of the first sub pixel a second transistor having gate, source and drain electrodes, wherein one of the source and drain electrodes of the second transistor is electrically connected to the signal line; and a third transistor having gate, source and drain electrodes and electrically connected in series with the first transistor, wherein the other one of the source and drain electrodes of the second transistor is electrically connected to the gate electrode of the third transistor, wherein the gate electrode of the first transistor is electrically connected to the first power supply line, wherein the gate electrode of the second transistor is electrically connected to the scan line, wherein the other one of the source and drain electrodes of the first transistor and one of the source and drain electrodes of the third transistor are electrically connected with each other, wherein the other one of the source and drain electrodes of the third transistor is electrically connected to the second power supply line, wherein the capacitor is provided between the gate electrode of the third transistor and the other one of the source and drain electrodes of the third transistor, and wherein the size of the light emitting area of the first sub pixel and the size of the light emitting area of the second sub pixel are different.

7. The display device according to claim 6, wherein the first transistor is a driving transistor and operates in a saturation region or a linear region.

8. The display device according to claim 6, wherein the second transistor is a switching transistor and operates in a linear region.

9. The display device according to claim 6, wherein the third transistor is a current controlling transistor and operates in a linear region.

10. The display device according to claim 6, wherein a thin film transistor having polycrystalline silicon is used for each of the transistors.

11. A display device comprising:

a signal line;

a scan line;

a first power supply line having a fixed potential;

a second power supply line;

a pixel including a first sub pixel and a second sub pixel wherein each of the first and second sub pixels has a light emitting element;

a first transistor having gate, source and drain electrodes, wherein one of the source and drain electrodes of the first transistor is electrically connected to the light emitting element of the first sub pixel a second transistor having gate, source and drain electrodes, wherein one of the source and drain electrodes of the second transistor is electrically connected to the scan line;

a third transistor having gate, source and drain electrodes and electrically connected in series with the first transistor, wherein the other one of the source and drain electrodes of the second transistor is electrically connected to the gate electrode of the third transistor; and a fourth transistor having gate, source and drain electrodes, wherein one of the source and drain electrodes of the fourth transistor is electrically connected to the gate electrode of the third transistor and the other one of the source and drain electrodes of the fourth transistor is electrically connected to the second power supply line, wherein the gate electrode of the first transistor is electrically connected to the first power supply line, wherein the gate electrode of the second transistor is electrically connected to the scan line, wherein the other one of the source and drain electrodes of the first transistor and one of the source and drain electrodes of the third transistor are electrically connected with each other, wherein the other one of the source and drain electrodes of the third transistor is electrically connected to the second power supply line; and wherein the size of the light emitting area of the first sub pixel and the size of the light emitting area of the second sub pixel are different.

12. The display device according to claim 11, wherein the first transistor is a driving transistor and operates in a saturation region or a linear region.

13. The display device according to claim 11, wherein the second transistor is a switching transistor and operates in a linear region.

14. The display device according to claim 11, wherein the third transistor is a current controlling transistor and operates in a linear region.

15. The display device according to claim 11, wherein the fourth transistor is an erasing transistor and operates in a linear region.

16. The display device according to claim 11, wherein a capacitor is provided between the gate electrode of the third transistor and the other one of the source and drain electrodes of the third transistor.

17. The display device according to claim 11, wherein a thin film transistor having polycrystalline silicon is used for each of the transistors.

18. A method for driving a display device comprising:

a signal line;

a scan line;

a first power supply line having a fixed potential;
a second power supply line;
a pixel including a first sub pixel and a second sub pixel wherein each of the first and second sub pixels has a light emitting element;
a first transistor electrically connected to the light emitting element of the first sub pixel
a second transistor for determining a light emission or a non-light emission of the light emitting element of the first sub pixel; and
a third transistor connected in series with the first transistor,
wherein a gate electrode of the first transistor is electrically connected to the first power supply line,
wherein one of source or drain electrodes of the third transistor is electrically connected to the second power supply line, and
wherein the size of the light emitting area of the first sub pixel and the size of the light emitting area of the second sub pixel are different,
which method comprising the steps of:
selecting the scan line;
turning ON the second transistor electrically connected to the scan line;
inputting a video signal from the signal line to the second transistor; and
turning ON the first transistor in accordance with the video signal, whereby the light emitting element emits light.

19. The method for driving a display device, according to claim 18,
wherein the third transistor is turned ON or OFF at the same time as the second transistor.

20. The method for driving a display device, according to claim 18,
wherein the display device further comprises a fourth transistor electrically connected between a gate electrode of the third transistor and the one of the source and drain electrodes of the third transistor; and
the fourth transistor discharges a potential of a video signal inputted from the signal line.

21. The method for driving a display device, according to claim 20, wherein the fourth transistor is an erasing transistor and operates in a linear region.

22. The method for driving a display device, according to claim 18, wherein the first transistor is a driving transistor and operates in a saturation region or a linear region.

23. The method for driving a display device, according to claim 18, wherein the second transistor is a switching transistor and operates in a linear region.

24. The method for driving a display device, according to claim 18, wherein the third transistor is a current controlling transistor and operates in a linear region.

25. A method for driving a display device comprising:
a signal line;
a scan line;
a first power supply line having a fixed potential;
a second power supply line;
a pixel including a first sub pixel and a second sub pixel wherein each of the first and second sub pixels has a light emitting element;
a first transistor electrically connected to the light emitting element of the first sub pixel
a second transistor for determining a light emission or a non-light emission of the light emitting element of the first sub pixel; and
a third transistor connected in series with the first transistor,
wherein a gate electrode of the first transistor is electrically connected to the first power supply line,
wherein one of source or drain electrodes of the third transistor is electrically connected to the second power supply line, and
wherein the size of the light emitting area of the first sub pixel and the size of the light emitting area of the second sub pixel are different,
which method comprising the steps of:
selecting the scan line;
turning ON the second transistor electrically connected to the scan line;
inputting a video signal from the signal line to the second transistor; and
turning ON or OFF the first transistor in accordance with the video signal, whereby the light emitting element emits light when the first transistor is turned ON.

26. The method for driving a display device, according to claim 25,
wherein the third transistor is turned ON or OFF at the same time as the second transistor.

27. The method for driving a display device, according to claim 25,
wherein the display device further comprises a fourth transistor electrically connected between a gate electrode of the third transistor and the one of the source and drain electrodes of the third transistor; and
the fourth transistor discharges a potential of a video signal inputted from the signal line.

28. The method for driving a display device, according to claim 27, wherein the fourth transistor is an erasing transistor and operates in a linear region.

29. The method for driving a display device, according to claim 25, wherein the first transistor is a driving transistor and operates in a saturation region or a linear region.

30. The method for driving a display device, according to claim 25, wherein the second transistor is a switching transistor and operates in a linear region.

31. The method for driving a display device, according to claim 25, wherein the third transistor is a current controlling transistor and operates in a linear region.

32. A method for driving a display device comprising:
a signal line;
a scan line;
a first power supply line having a fixed potential;
a second power supply line;
a pixel including a first sub pixel and a second sub pixel wherein each of the first and second sub pixels has a light emitting element;
a first transistor electrically connected to the light emitting element of the first sub pixel
a second transistor for determining a light emission or a non-light emission of the light emitting element of the first sub pixel; and
a third transistor connected in series with the first transistor,
wherein a gate electrode of the first transistor is electrically connected to the first power supply line,
wherein one of source or drain electrodes of the third transistor is electrically connected to the second power supply line, and
wherein the size of the light emitting area of the first sub pixel and the size of the light emitting area of the second sub pixel are different, which method comprising the steps of:

selecting the scan line;

turning ON the second transistor electrically connected to the scan line;

inputting a video signal from the signal line to the second transistor; and turning ON or OFF the first transistor in accordance with the video signal, whereby the light emitting element emits light when the first transistor is turned ON, wherein gray scale display is performed by selecting the light emitting area of the first sub pixel.

33. The method for driving a display device, according to claim 32, wherein the third transistor is turned ON or OFF at the same time as the second transistor.

34. The method for driving a display device, according to claim 32, wherein the display device further comprises a fourth transistor electrically connected between a gate electrode of the third transistor and the one of the source and drain electrodes of the third transistor; and the fourth transistor discharges a potential of a video signal inputted from the signal line.

35. The method for driving a display device, according to claim 34, wherein the fourth transistor is an erasing transistor and operates in a linear region.

36. The method for driving a display device, according to claim 32, wherein the first transistor is a driving transistor and operates in a saturation region or a linear region.

37. The method for driving a display device, according to claim 32, wherein the second transistor is a switching transistor and operates in a linear region.

38. The method for driving a display device, according to claim 32, wherein the third transistor is a current controlling transistor and operates in a linear region.

39. A method for driving a display device comprising:

a signal line;

a scan line;

a first power supply line having a fixed potential;

a second power supply line;

a pixel including a first sub pixel and a second sub pixel wherein each of the first and second sub pixels has a light emitting element;

a first transistor electrically connected to the light emitting element of the first sub pixel a second transistor for determining a light emission or a non-light emission of the light emitting element of the first sub pixel; and a third transistor connected in series with the first transistor, wherein a gate electrode of the first transistor is electrically connected to the first power supply line, wherein one of source or drain electrodes of the third transistor is electrically connected to the second power supply line, and wherein the size of the light emitting area of the first sub pixel and the size of the light emitting area of the second sub pixel are different, which method comprising the steps of:

selecting the scan line in a writing period;

turning ON the second transistor electrically connected to the scan line in a writing period;

inputting a video signal from the signal line to the second transistor in a writing period; and turning ON or OFF the first transistor in accordance with the video signal, the light emitting element emits light when the first transistor is turned ON, and the light emitting element emits no light when the first transistor is turned OFF in a light emitting period, wherein a unit frame period comprising the writing period and the light emitting period.

40. The method for driving a display device according to claim 39, wherein the unit frame period comprises a plurality of sub frame periods, and wherein each of the sub frame periods comprises a writing period and a light emitting period.

41. The method for driving a display device according to claim 39, wherein the unit frame period comprises a plurality of sub frame periods, wherein each of the sub frame periods comprises a writing period and a light emitting period, and wherein any of the sub frame periods comprises an erasing period in which a potential of a video signal inputted from the signal line is discharged.

* * * * *